US008268155B1

(12) United States Patent
Zhou et al.

(10) Patent No.: US 8,268,155 B1
(45) Date of Patent: Sep. 18, 2012

(54) COPPER ELECTROPLATING SOLUTIONS WITH HALIDES

(75) Inventors: Jian Zhou, West Linn, OR (US); Jonathan D. Reid, Sherwood, OR (US)

(73) Assignee: Novellus Systems, Inc., San Jose, CA (US)

( * ) Notice: Subject to any disclaimer, the term of this patent is extended or adjusted under 35 U.S.C. 154(b) by 487 days.

(21) Appl. No.: 12/573,762

(22) Filed: Oct. 5, 2009

(51) Int. Cl.
*C25D 5/02* (2006.01)
*C25D 3/38* (2006.01)

(52) U.S. Cl. ..... 205/123; 205/291

(58) Field of Classification Search ..... 205/123, 205/291, 296
See application file for complete search history.

(56) References Cited

U.S. PATENT DOCUMENTS

| | | | | |
|---|---|---|---|---|
| 2,931,760 | A | 4/1960 | Westbrook | |
| 6,126,798 | A | 10/2000 | Reid et al. | |
| 6,569,299 | B1 | 5/2003 | Reid et al. | |
| 6,652,731 | B2 | 11/2003 | Cobley et al. | |
| 7,186,326 | B2 | 3/2007 | Shalyt et al. | |
| 7,776,741 | B2 | 8/2010 | Reid et al. | |
| 2004/0016647 | A1 | 1/2004 | Yang et al. | |
| 2004/0217009 | A1 * | 11/2004 | Mikkola et al. | 205/296 |
| 2005/0081744 | A1 * | 4/2005 | Klocke et al. | 106/1.18 |

OTHER PUBLICATIONS

Hayase et al., "Preferential Copper Electrodeposition at Submicrometer Trenches by Consumption of Halide Ion," Electrochrochemical and Solid-State Letters, 6 (6) C92-C95 (2003), Mar. 25, 2003.

* cited by examiner

*Primary Examiner* — Luan Van
(74) *Attorney, Agent, or Firm* — Weaver Austin Villeneuve & Sampson LLP

(57) ABSTRACT

Methods, electroplating solution, and apparatuses for electroplating copper into a surface of a partially fabricated semiconductor substrate are provided. Electroplating solutions include copper ions, suppressor additives, chloride ions, and alternative halide ions, which include bromide ions and/or iodide ions. The concentration of the alternative halide ions in the solution may be between about 0.25 ppm and 20 ppm. Addition of the alternative halide ions at certain concentrations improves suppression properties of the solution over a range of feature sizes without a need to change suppressors.

21 Claims, 9 Drawing Sheets

COPPER ELECTROPLATING SOLUTIONS WITH HALIDES

BACKGROUND

Electroplating copper into small and some large high aspect ratio features may present various technical issues, such as seams and voids, streaks and surface roughness, and slow process throughputs. These issues may become even more severe when substrates have a thin seed, poor seed coverage, and/or when processing is performed at conditions that are close to the suppressor's cloud point, and other factors. For example, physical vapor deposition (PVD) of a seed layer often results in a film that is not conformal and has substantial variations in its thickness (e.g., having thin portions) and some gaps in coverage, especially gaps in coverage of the sidewalls and bottoms of the features. Electroplating over such seed layers may result in voids, which are unfilled pockets inside the features corresponding to the seed layer defects and caused by slower deposition rates in the areas where the seed layer is thin or missing, and other defects. Further, electro-filling large features, such as Through Silicon Vias (TSVs), may be challenging since mass transport in such features is substantially different than in smaller-size features, such as Damascene structures and vias. Most suppressors are often not sufficiently robust to address the above issues for a wide range of feature sizes. Changing suppressor formulations and concentrations can be costly and often leads to new issues associated with suppressor distribution within the solution (i.e., a cloud point) and distribution on the deposition surface. Accordingly, improved methods and apparatus to deposit copper are needed.

SUMMARY

Adding alternative halide ions, such as bromide ions and iodide ions, to a copper electroplating solution together with chloride ions accelerates and strengthens adsorption of a wide range of suppressors onto the processing surface. This helps to increase polarization, thereby allowing electroplating over thin seed layers, faster bottom-up fill in both large and small features, as well as other benefits. The experiments described below showed that these novel electroplating solution compositions provide void-free characteristics of the filling process while maintaining and even increasing the electroplating rates. Baths containing both chloride and alternative halide ions demonstrated higher and faster galvanostatic polarization. For example, in large features, such as Through Silicon Vias (TVSs), suppressor molecules more easily diffuse the bottom of the features and a suppression gradient may be harder to establish than in smaller features. Yet, higher electroplating rates are needed for larger features for process throughout. Addition of the alternative halide ions helps to achieve faster, stronger, and more pronounced adsorption of the suppressor near the opening of large features, which establishes suppression gradient.

In certain embodiments, a method of electroplating copper onto a surface of a partially fabricated semiconductor substrate is provided. The surface may include a field region, a plurality of recessed features, and a metal seed layer. The method involves contacting the surface with an electroplating solution in an electroplating apparatus and, while contacting, electroplating copper onto the surface by passing an electrical current to fill the recessed features with copper. In certain embodiments, the electroplating solution includes copper ions, a suppressor additive, chloride ions, and alternative halide ions, such as bromide ions and/or iodide ions.

In certain embodiments, the concentration of the alternative halide ions is between about 0.25 parts per million and about 20 parts per million or, in more specific embodiments, between about 0.5 parts per million and about 5 parts per million. In the same or other embodiments, a ratio of the concentration of the chloride ions to the concentration of the alternative halide ions is between about 1 and about 100 or, in more specific embodiments, between about 5 and about 25. The concentration of the suppressor additive may be between about 10 milligrams per liter and about 500 milligrams per liter, while the concentration of the copper ions may be between about 10 grams per liter and about 70 grams per liter. Further, in certain embodiments, the electroplating solution includes a sulfuric acid and/or a methanesulfonic acid. The concentration of these acids may be between about 10 grams per liter and about 150 grams per liter.

In certain embodiments, at least one of the recessed features has a width of less than about 50 nanometers. Substrate with such features may be electroplated at a current density of between about 1.0 $mA/cm^2$ and 80 $mA/cm^2$. In the same of other embodiments, at least one of the recessed features has a width of at least about 500 nanometers. Substrate with such features may be electroplated at a current density of between about 1.0 $mA/cm^2$ and 50 $mA/cm^2$. Some of the recessed features have an aspect ratio of at least about 5:1.

The current method may be used to electroplate copper over the seed layer that has substantially non-uniform thickness and/or has an average thickness of less than about 20 nanometers. In some examples, the seed layer is non-continuous in some of the recessed features. In certain embodiments, the alternative halide ions provide additional suppression of the field region thereby increasing an electroplating potential inside the features. The increase in the electroplating potential may be sufficient to overcome seed layer defects, enhance copper nucleation on the seed layer, and to electroplate copper into the features substantially free from sidewall voids. Nucleation density is improved over many conventional electroplating methods and electroplating solutions due to the higher polarization of the disclosed methods and solutions within the electroplating bath.

In certain embodiments, the electroplating solution includes an accelerator additive and a leveler additive. The concentration of the accelerator may be between about 5 mg per liter and 40 mg per liter, while the concentration of the suppressor may be between about 50 mg per liter and 400 mg per liter, and the concentration of the leveler may be between about 0.5 mg per liter and 40 mg per liter. The copper ions may be provided from a copper salt, such as copper methane sulfonate, copper sulfate, copper pyrophosphate, copper propanesulfonate, and combination of thereof. The concentration of chloride ions may be at least about 10 ppm or, more specifically, at least about 30 ppm. In certain embodiments, an acid, such as sulfuric acid or methanesulfonic acid, is added to control the conductivity of the electroplating solution. The sulfuric acid concentration may be between about 10 grams per liter and about 150 grams per liter.

In certain embodiments, a copper electroplating solution for electroplating copper onto a surface of a partially fabricated semiconductor substrate is provided. The solution may include copper ions, a suppressor additive, chloride ions, and alternative halide ions, such as bromide ions, iodide ions, and a combination of thereof. In certain embodiments, the concentration of the alternative halide ions is between about 0.25 parts per million and about 20 parts per million or, more specifically, between about 0.5 parts per million and about 5 parts per million.

In certain embodiments, an electroplating apparatus for depositing copper is provided. The apparatus may include a vessel for containing an electroplating bath, a source of an electroplating solution configured to deliver and maintain the electroplating solution in the electroplating bath, and a controller for executing a set of instructions. The electroplating solution may include copper ions, a suppressor additive, chloride ions, and alternative halide ions, such as bromide ions and iodide ions. The instructions may include contacting the surface with the electroplating solution in the electroplating apparatus and electroplating copper onto the surface by passing an electrical current to fill the recessed feature with copper.

DETAILED DESCRIPTION OF EXAMPLE EMBODIMENTS

Figure 1:
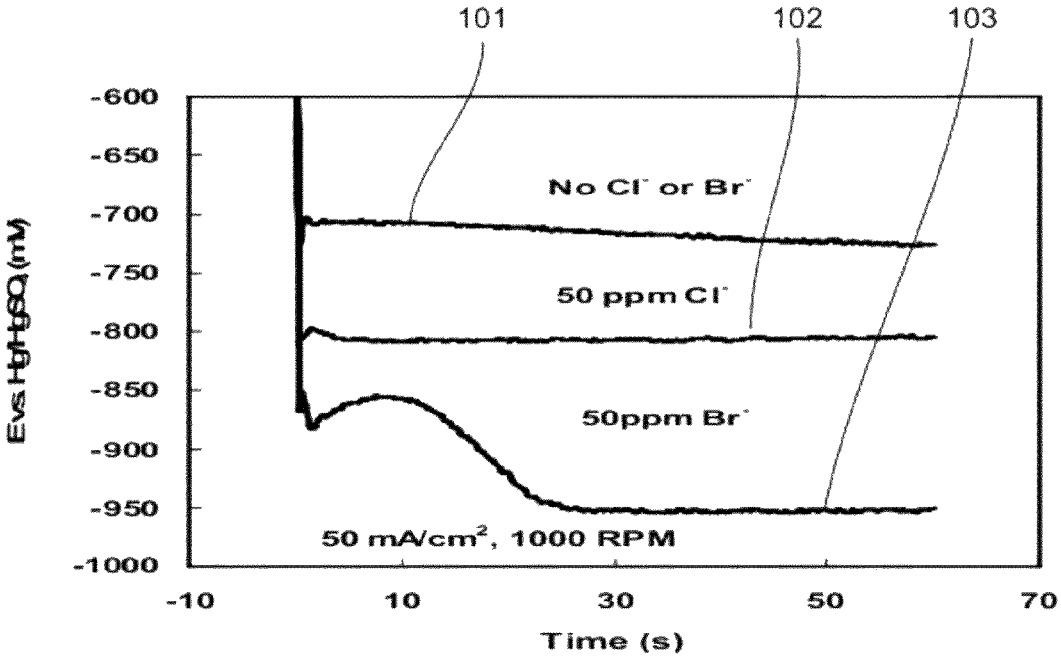
FIG. 1 illustrates galvanostatic polarization of three electroplating solution examples with different halide ion compositions.

In the following description, numerous specific details are set forth in order to provide a thorough understanding of the present invention. The present invention may be practiced without some or all of these specific details. In other instances, well known process operations have not been described in detail to not unnecessarily obscure the present invention. While the invention will be described in conjunction with the specific embodiments, it will be understood that it is not intended to limit the invention to the embodiments.

Electroplating solutions containing copper ions are commonly used in semiconductor manufacturing to fill damascene and through silicon via (TSV) features. Besides a source of copper ions, such as copper sulfate and various other salts listed below, these solutions typically contain sulfuric acid to control the conductivity and various organic additives, such as accelerators, suppressors, and levelers. Accelerators enhance deposition rates and usually accumulate inside the features where the concentration of the suppressors is less. An example of an accelerator is Viaform Extreme Accelerator supplied by Enthone in West Haven, Conn. Accelerators may be used at concentrations of between about 5 mg per liter to about 40 mg per liter. Levelers may be used to deactivate accelerator functions and to achieve planar plating on the field region once the features are filled. An example of a leveler is Viaform Extreme Pura Leveler supplied by Enthone in West Haven, Conn. Levelers may be used at concentrations of between about 0.5 mg per liter to about 40 mg per liter.

Suppressors are used to profile copper deposition rates through the deposition surface. An example of a suppressor is Viaform Extreme Plus Suppressor supplied by Enthone in West Haven, Conn. Suppressors may be used at concentrations of between about 50 mg per liter to about 400 mg per liter.

Upon contacting an electroplating solution with the partially manufactured semiconductor substrate, large suppressor molecules generally start being adsorbed by more accessible surface portions of the substrate, such as the field region and areas near the feature openings, and then slowly diffuse deeper into the features. Thus, an initial gradient in suppression of different surfaces may exist. It is often desirable, as will be explained more below in the context of specific embodiments, to expedite initial adsorption on the field region and/or to maintain suppression gradient for longer time. One way to achieve faster adsorption is to use a stronger suppressor or to increase suppressor's concentration. However, both of these approaches may cause agglomeration or "clouding" of the suppressor in the solution and/or may produce uneven distribution of the suppressor on the substrate surface causing streaks and localized film roughness due to poor nucleation. Further, higher suppressor concentrations tend to shorten the lifetime of the suppression gradient.

Another way to enhance adsorption characteristics of suppressor is by adding bridging species to the plating solution. A common example of bridging species is chloride ions. A proposed mechanism involves forming a copper chloride (CuCl) film on the copper seed layer to which suppressor molecules bond faster and form stronger bonds than to the seed layer directly. Bridging species also help to maintain a suppression gradient as their own distribution along the feature depth is typically graded, particularly at low concentrations. Adsorbing and retaining suppressor molecules by the suppressor bound to the seed layer along the way as they diffuse deeper into the feature allows fewer molecules to reach the feature bottom.

Yet chloride ions often do not provide adequate adsorption speed and strength. For example, small features (e.g., less than about 50 nanometers) tend to fill and close before the suppressor takes full effect in the plating solution containing chloride ions. Chloride ions were also found not to be sufficiently effective in large features, such as TSV features. While some issues can be addressed with more powerful suppressors and/or highly concentrated suppressor solutions, development of new suppressors can be costly and may result in "clouding" as described above.

It has been found that suppression effects of halides ions increase in the following order: chloride<bromide<iodide. For the purposes of this document, bromide ions and iodide ions are collectively referred to as "alternative halide ions" to distinguish them from conventionally used chloride ions. FIG. 1 illustrates galvanostatic polarization of three plating solutions containing different halide ion compositions. The polarization is characterized with voltage measurements taken during electroplating a controlled sample at a constant current. Stronger polarization represents more suppression and corresponds to higher voltage measurements. In this experiment, 4-mm platinum disks were submerged into a plating solution containing copper ions from dissolving copper sulfate. The disks were rotated at about 1000 RPM and were exposed to a current density of about 50 $mA/cm^2$ for about one minute. All three solutions contained suppressors, levelers, and accelerators. The top line 101 represents a solution that did not have any bridging species. It has the lowest potential of about 700 mV during the stable deposition regime (the flat portion of the curve). The middle line 102 with a potential of at about 800 mV represents a solution with about 50 ppm of chloride ions. The suppression level improved (from 700 mV to 800 mV) relative to the first solution. Finally, the third line 103 with a potential of about 950 mV represents a plating solution with about 50 ppm bromide ions. It was the most polarized of the three tested samples. This experiments confirmed that replacing chloride ions with bromide ions substantially increase polarization. However, it has been also found that such increase in polarization that results from replacing chloride ions with bromide ions creates a new set of problems that, in some ways, are similar to those encountered using stronger and more concentrated suppressors. Further, iodides have poor solubility (e.g., for cupric iodide, $K_{sp,\ 25°\ C.}=1.27\times10^{-12}$) and can not provide sufficient bridging characteristics within available solubility ranges.

Disclosed plating solutions and methods of using such solution for electroplating address some of these problems. In certain embodiments, these solutions include both chloride ions and trace amounts of the alternative halide ions. In certain embodiments, trace amounts are between about 100 ppb and 10,000 ppb (10 ppm) or, more specifically, between about 500 ppb and 5,000 ppb (5 ppm). Even at these low concentrations, the alternative halide ions provide significant improvements in suppression when used together with chloride ions. For example, it has been experimentally established that addition of 500 ppb of bromide ions to the electroplating solution provided a greater degree of suppression than doubling the concentration of the suppressor in that solution. Further, keeping the concentration of the alternative halide ions to such low levels and not introducing stronger suppressors or increasing concentrations of the suppressors helps to avoid problems with "clouding."

Increase in suppression by the disclosed solutions demonstrated higher fill rates, reduced sidewall voids in features with marginal seed coverage, improved fill uniformity in dies, better stress migration in plated films, and increased elasticity of films. For example, stronger suppression helps to improve partial fill rates due to the increased suppression difference between the wafer field region and areas inside the features. This suppression difference is caused by the transient suppressor concentration gradient that exists during initial stages of the plating process. Further, enhanced suppression increases a potential during the galvanostatic plating, which is believed to help copper nucleation along sidewalls. This may be useful in features with marginal seed coverage, such as small and high aspect ratio features, and thin seed layers.

Figure 2:
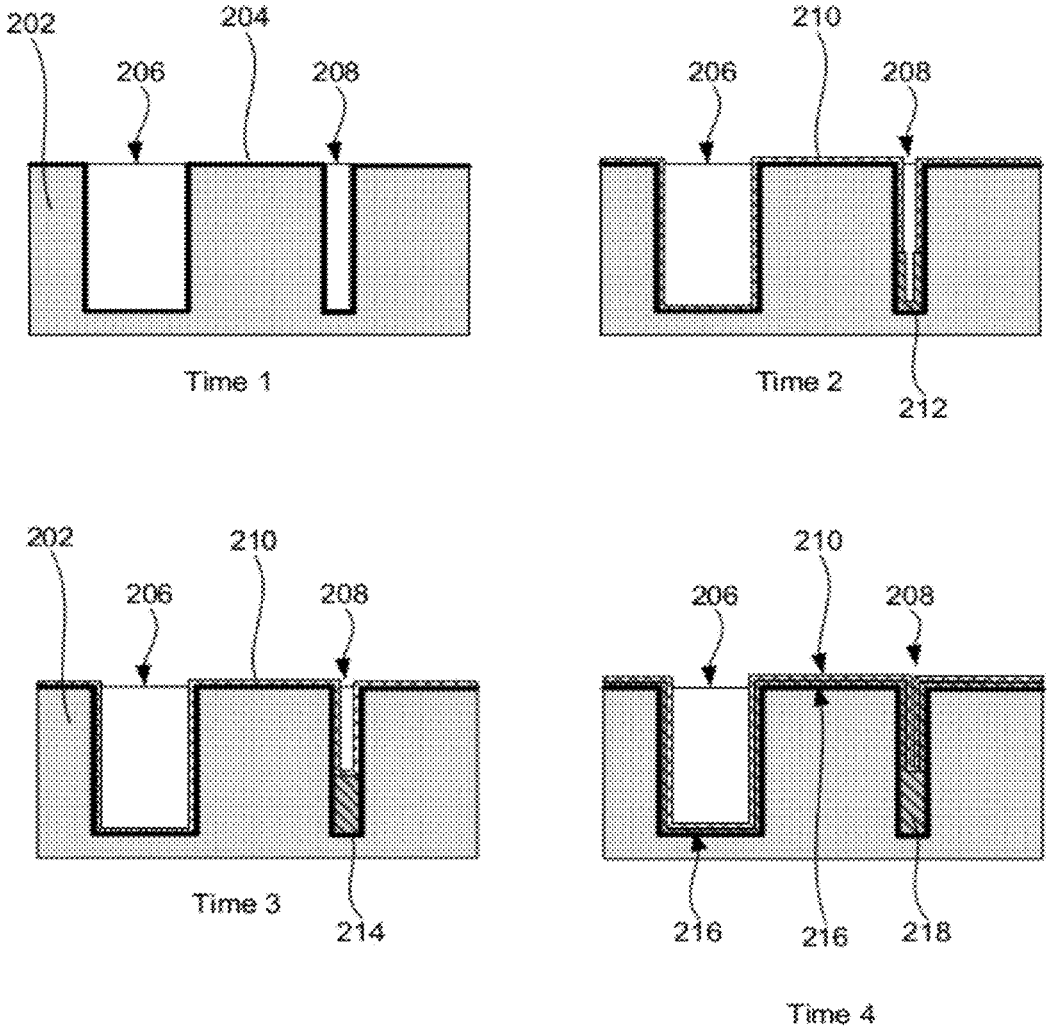
FIG. 2 is a schematic diagram showing an example of electroplating mechanism in a small feature and a large feature using an electroplating solution with a suppressor in accordance with certain embodiments.

FIG. 2 is a schematic diagram showing an example of an electroplating mechanism in a small feature using electroplating solution containing suppressor and comparing this mechanism to that in a larger feature. This mechanism provides a framework for the process described in the context of FIG. 3 below. A partially manufactured semiconductor substrate 202 is introduced at "Time 1" into the plating bath with an electroplating solution that contains a suppressor. The substrate 202 includes a large feature 206 and a small feature 208 as shown in FIG. 2. Different size features are used to illustrate differences in suppressor effects in such features. As noted below, certain electroplating solution formulations may help to minimize these differences. Conceptually, a small feature may be defined as a feature that provides substantial resistance to diffusion of the suppressor into the feature.

Once the substrate is introduced into the plating solution, suppressor molecules start adsorbing onto the surface of the substrate and form a suppressor layer 210 as shown at "Time 2." However, in a short period between "Time 1" and "Time 2", only very few, if any, large suppressor molecules diffuse into the small feature 208. As a result, the lower portions of the small feature 208 do not have an effective suppressor layer similar to the layer 210. Unsuppressed deposition of copper 212 may occur at the bottom of the small feature 208, while deposition on the field and near the opening is suppressed by the layer 210. At the same time, the layer 210 may fully developed in the large feature 206 between "Time 1" and "Time 2", where diffusion of the suppressor molecules is less restricted. In certain embodiments, described below, these scenarios may be changed by introducing alternative halide ions into the electroplating solutions, which help to establish a suppressor gradient even in larger features, such as TSVs. Depending on a suppressor type and its concentration, electroplating solution composition, features sizes, deposition currents, and other process parameters, a period between "Time 1" and "Time 2" may be as little as 0.1 seconds or as large as 1 second. Addition of the alternative halide ions increases a suppression gradient inside the features (both small and large) and may result in accelerated deposition of copper near the bottom of the larger features too (not shown).

At "Time 3" the substrate may have substantial amounts of copper 214 deposited at the bottom of the small feature 208, while copper deposition on the other surfaces is slowed down by the suppressor layer 210. Eventually, enough suppressor molecules diffuse into the small feature 208 to develop an effective suppressor layer 210 there as well, and the deposition rate inside the small feature becomes suppressed at "Time 3" as well. It should be noted that the described mechanisms are gradual and various time frames and characterizations (e.g., "suppressed", "not suppressed") are for illustrative purposes only. In certain embodiments, a period between "Time 1" and "Time 3" is substantially increased by adding trace amounts of the alternative halide ions into the plating solution. Eventually ("Time 4"), enough copper 214 is deposited under the suppressor layer 210. A period between "Time 1" and "Time 4" also depends on the factors listed above and may be as little as 1 seconds or as large as 10 second.

Alternative halide ions in the electroplating solution may result in a gradient distribution of these ions within large features, such as TSVs, as well as small features (not shown in FIG. 2) despite the differences in mass transport characteristics for different size features. Some examples of the feature sizes are presented below. Such gradient distribution of the alternative halide ions (i.e., more halide ions near the opening than deeper inside the features) causes a gradient suppressor distribution and result in more suppression near the opening than deeper inside, which enhances bottom-up filling.

Figure 3:
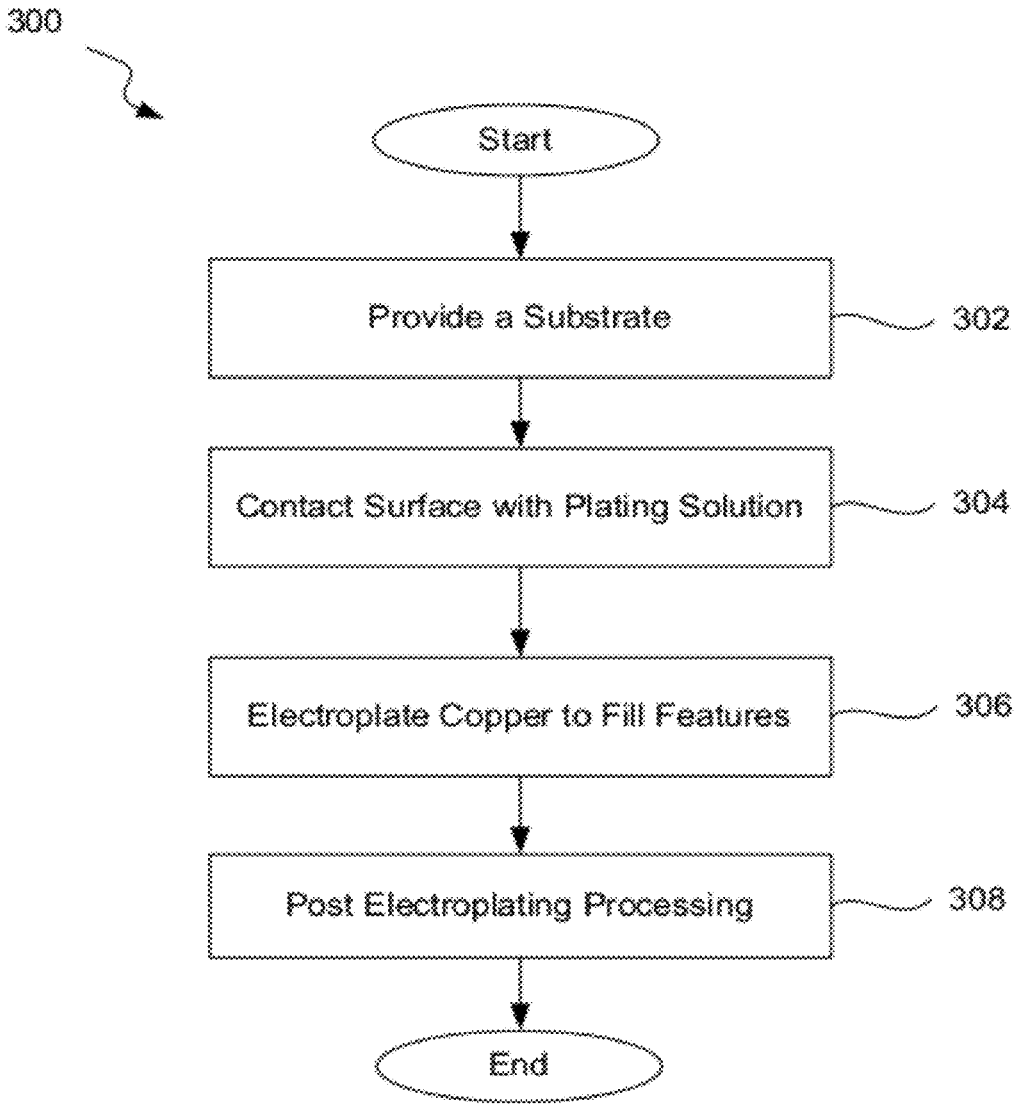
FIG. 3 is a process flow diagram of a method of electroplating copper onto a surface of a partially fabricated semiconductor substrate in accordance with certain embodiments.

FIG. 3 is a process flow diagram of a method 300 for electroplating copper onto a surface of a partially fabricated semiconductor substrate in accordance with certain embodiments. A process may start with providing such substrate into the electroplating chamber in operation 302. The substrate may be a wafer (e.g., 200-mm wafer, 300-mm wafer, 450-mm wafer, etc.), a die, or any other suitable substrate.

The substrate may have various features to be filled with copper. In certain embodiments, the substrate has features that are less than about 100 nm in size or, in more specific embodiments, are less than about 50 nm. In other embodiments, the substrate has features that at least about 500 nm in size or, in more specific embodiments, at least about 1,000 nm in size. A specific example of these larger features is a TSV, which may be between about 1 micrometer and about 50 micrometers in diameter and between about 10 micrometers and about 200 meters in depth. In the same or other embodiments, features have aspect ratio of at least about 4:1 or, more specifically, at least about 10:1 or even at least about 20:1. Examples of such features include Through Silicon Vias (TSV), which are described in more details in U.S. patent application Ser. No. 12/193,644 filed on Aug. 18, 2008, which is incorporated herein in its entirety for the purpose of describing TSVs.

To prevent copper migration from the circuit features into the surrounding dielectric a diffusion barrier layer may be deposited before depositing a copper seed layer and electroplating. In certain embodiments, a diffusion barrier layer may be integrated together with a seed layer. A physical vapor deposition (PVD) process may be used to deposit a diffusion barrier layer having a thickness of between about 5 nanometers and about 50 nanometers. Examples of diffusion barrier materials include, but not limited to, tungsten and titanium as well as their nitrides, carbides, and oxides.

A copper seed layer may be then deposited over the diffusion barrier layer, if one is present. The seed layer is intended to provide a uniform voltage profile during the electroplating and to achieve better adhesion of the electroplated copper to the dielectric. A seed layer may be deposited using a PVD as well. For example, seed layers with a thickness of between about 5 nm and 100 nm or, more specifically between about 10 nanometers and 40 nm, in Damascene types of structures may be used. Thin seed layers may be also characterized with a sheet resistance, which in certain embodiments is between about 0.2 Ohm per square and 20 Ohm per square or, in more specific embodiments, between about 0.5 Ohm per square and 5 Ohm per square. In other examples, seed layers with a thickness of between about 10 nm and 1,000 nm in TSV types of structures are used.

While it is desirable to have a continuous and uniform seed layer, a seed layer is often not uniform and has gaps in coverage. Localized corrosion dissolution and low local plating rates may appear in those regions. In certain embodiments, at least about 1% of the deposition surface is not covered by a seed layer (i.e., at least 1% of the layer is missing or gaps in the seed layer constitute at least 1% of the total seed layer area). In more specific embodiments, at least 5% of the deposition surface is not covered by a seed layer. Further, a seed layer may have uneven thickness distribution, i.e., a substantially non-uniform seed layer. In certain embodiments, variations in a film thickness is at least about 10% or, in more specific examples, at least about 50% or even at least about 100%. Also rough and irregular etch profiles can locally shadow some feature surfaces during PVD deposition. Yet, many of these seed layer deficiencies may be overcome with novel plating solution compositions.

Pre-treatment of the copper seed layer may be desirable in some processes to achieve uniform wetting. Because pretreatments often etch small amounts of copper seed, it is often desirable that a minimum seed layer thickness be at least about 4 nanometers when a pre-treatment step is used. Pretreatment can be performed using water, dilute acidic or basic solutions, solutions containing strong surfactants, plating solutions, or combinations of thereof. The seed layer may be susceptible to dissolution in the electrolyte by the electrolyte's own exchange current. Thus, a small voltage may be applied to the dielectric before it is introduced into the plating solution. Alternatively, the plating current is applied instantaneously as the substrate comes in contact with the plating solution.

A plating solution typically includes copper ions, sulfuric acid, additives, and bridging species. A concentration of copper ions may be between about 10 grams per liter and about 70 grams per liter. The source of copper ions may be copper sulfate ($CuSO_4$), copper methane sulfonate ($Cu(CH_3SO_3)_2$), copper gluconate ($C_{12}H_{22}CuO_{14}$), copper sulfamate, copper nitrate, copper phosphate, copper chloride and others. Higher concentrations of copper ions may be more desirable for plating larger features, such as TSVs, and for promoting faster deposition rates. Some of the compounds listed above have limited solubility, which may be overcome by raising the temperature of the solution to between about 40° C. and about 75° C. However, higher copper concentrations may decrease the cloud point of solution, which is the temperature at which suppressor molecules start agglomerating A suppressor concentration may need to be lowered to overcome this issue. Novel plating solutions including trace amounts of alternative halide ions may include relatively low suppressor concentrations, and thereby accommodate higher copper concentrations, while maintaining adequate suppression levels.

In certain embodiments, an acid, such as sulfuric acid or methanesulfonic acid, is added to control the conductivity of the electroplating solution. In case of sulfuric acid the acid concentration may be between about 10 gram per liter and about 150 gram per liter. In other embodiments, sulfonic ($R—S(=O)_2—OH$) acids and/or methanesulfonic acids are used. The pH of the solution may be between about 2 and 6, or more specifically, between about 3 and 5. Higher acid concentrations increase the conductivity of the plating solution, thereby provide more uniform current distribution. However, a high concentration of highly mobile hydrogen ions impedes the transfer of the lower mobility copper ions by migration.

Examples of different additive and bridging species are provided above. In certain embodiments, a solution includes between about 10 grams per liter and about 70 grams per liter of copper ions, between about 0 and about 200 grams per liter of sulfonic acid, and between about 10 milligrams per liter and about 500 milligrams per liter organic additives (suppressors, accelerators, and additive), and between about 10 parts per million and 100 parts per million chloride ions. In one embodiment, the solution contains between about 0.5 parts per million and 10 parts per million bromide ions. In another embodiment, the solution contains between about 0.5 parts per million and 2 parts per million iodide ions. Further, both bromide ions and iodide ions may be present in the same solution at concentrations providing adequate degree of suppression and/or polarization.

In certain embodiments, the concentration of the alternative halide ions is between about 0.25 parts per million and about 20 parts per million or, in more specific embodiments, between about 0.5 parts per million and about 5 parts per million. In the same or other embodiments, a ratio of the concentration of the chloride ions to the concentration of the alternative halide ions is between about 1 and about 100 or, in more specific embodiments, between about 5 and about 25. The concentration of the suppressor additive may be between about 10 milligrams per liter and about 500 milligrams per liter, while the concentration of the copper ions may be between about 10 grams per liter and about 70 grams per liter.

The plating solution may also include an oxidizing agent, such as dissolved oxygen gas, hydrogen peroxide and other organic and inorganic peroxides, Fe(III) ion, Ce(IV) ion, ozone, chlorine, iodine, bromine, sulfides, disulfides or oxidizing additives (particularly accelerators, such as bis(sodium sulfopropyl)disulfide (SPS)) and other oxidizing compounds. To control the oxidizing behavior of the solution, reducing agents, such as glyoxylic acid, formaldehyde, ammonium hypophosphite, and dimethylamineborane, may be used.

The substrate may be rotated and vibrated while in the contact with the plating solution to provide agitation around the boundary layer. For example, at a rotational speed of between about 20 rpm and about 50 rpm may be used.

After contacting the surface with the plating solution, the process may continue with electroplating copper to fill the feature (block 306). The plating may be performed by passing the current with the density of between about 1.0 mA/cm$^2$ and 80 mA/cm$^2$ for the substrates with the features that are less than 50 nm in size. For larger features, such as at least about 500 nm in size, the current density may be between about 1.0 mA/cm$^2$ and 50 mA/cm$^2$.

Additionally, the dissolution cycle may be performed at high current density for very short intervals leading to removal of peaks and widening of unfilled feature openings (e.g., to prevent premature feature closing). Furthermore, the deposition interval may be mixed with equilibration interval that allows for copper ion concentration within the features to equilibrate.

After electroplating copper material into the feature holes, the wafer may go through one or more post electrofill processing operations (block 308). If an overburden is present, it will need to be removed in one of these operations. For example, chemical mechanical polishing (CMP) may be used. Other operations may include electro-planarization and/or chemical etching.

A general electroplating hardware is now discussed to provide context for the present invention. The apparatus includes one or more electroplating cells in which the wafers are processed. To optimize the rates and uniformity of electroplating, additives are added to the electrolyte. However, an electrolyte with additives may react with the anode in undesirable ways. Therefore, anodic and cathodic regions of the plating cell are sometimes separated by a membrane so plating solutions of different composition may be used in each region. A plating solution in the cathodic region is called catholyte. In the anodic region, it is called anolyte. A number of engineering designs can be used in order to introduce anolyte and catholyte into the plating apparatus.

Figure 4:
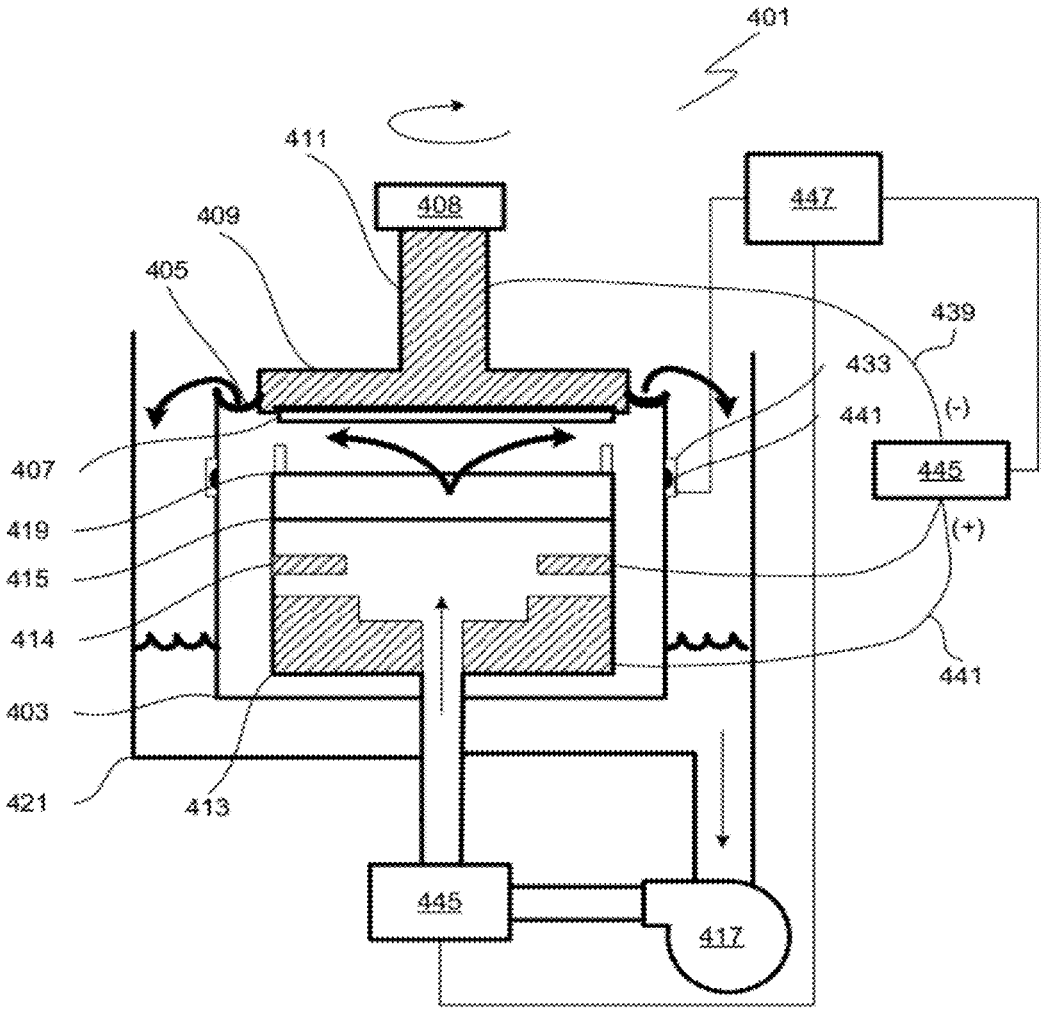
FIG. 4 is a diagrammatical cross-sectional view of an electroplating apparatus in accordance with one embodiment.

Referring to FIG. 4, a diagrammatical cross-sectional view of an electroplating apparatus 401 in accordance with one embodiment is shown. The plating bath 403 contains the plating solution (having a composition as described above), which is shown at a level 405. The catholyte portion of this vessel is adapted for receiving wafers in a catholyte. A wafer 407 is immersed into the plating solution and is held by, e.g., a "clamshell" holding fixture 409, mounted on a rotatable spindle 411, which allows rotation of clamshell 409 together with the wafer 407. A general description of a clamshell-type plating apparatus having aspects suitable for use with this invention is described in detail in U.S. Pat. No. 6,156,167 issued to Patton et al., and U.S. Pat. No. 6,800,187 issued to Reid et al., which are incorporated herein by reference for all purposes.

An anode 413 is disposed below the wafer within the plating bath 403 and is separated from the wafer region by a membrane 415, preferably an ion selective membrane. For example, Nafion™ cationic exchange membrane (CEM) may be used. The region below the anodic membrane is often referred to as an "anode chamber." The ion-selective anode membrane 415 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference for all purposes. Ion exchange membranes, such as cationic exchange membranes are especially suitable for these applications. These membranes are typically made of ionomeric materials, such as perfluorinated co-polymers containing sulfonic groups (e.g. Nafion™), sulfonated polyimides, and other materials known to those of skill in the art to be suitable for cation exchange. Selected examples of suitable Nafion™ membranes include N324 and N424 membranes available from DuPont de Nemours Co in Wilmington, Del.

During the plating the ions from the plating solution are deposited on the substrate. The metal ions must diffuse through the diffusion boundary layer and into the feature hole. A typical way to assist the diffusion is through convection flow of the electroplating solution provided by the pump 417. Additionally, a vibration agitation or sonic agitation member may be used as well as wafer rotation. For example, a vibration transducer 408 may be attached to the wafer chuck 409.

The plating solution is continuously provided to plating bath 403 by the pump 417. Generally, the plating solution flows upwards through an anode membrane 415 and a diffuser plate 419 to the center of wafer 407 and then radially outward and across wafer 407. The plating solution also may be provided into anodic region of the bath from the side of the plating bath 403. The plating solution then overflows plating bath 403 to an overflow reservoir 421. The plating solution is then filtered (not shown) and returned to pump 417 completing the recirculation of the plating solution. In certain configurations of the plating cell, a distinct electrolyte is circulated through the portion of the plating cell in which the anode is contained and mixing with the main plating solution is prevented using sparingly permeable membranes or ion selective membranes.

A reference electrode 441 is located on the outside of the plating bath 403 in a separate chamber 433, which chamber is replenished by overflow from the main plating bath 403. A reference electrode 441 is typically employed when electroplating at a controlled potential is desired. The reference electrode 441 may be one of a variety of commonly used types such as mercury/mercury sulfate, silver chloride, saturated calomel, or copper metal. In the context of this invention, voltages applied to the wafer are expressed relative to the copper metal reference electrode.

A DC power supply 435 can be used to control current flow to the wafer 407. The power supply 435 has a negative output lead 439 electrically connected to wafer 407 through one or more slip rings, brushes, and contacts (not shown). The positive output lead 441 of power supply 435 is electrically connected to an anode 413 located in plating bath 403. The power supply 435 and a reference electrode 441 can be connected to a system controller 447 among other functions, which allows modulation of current and potential provided to the elements of electroplating cell. For example, the controller may allow electroplating either in galvanostatic (controlled current) or potentiostatic (controlled potential) regime. The controller may include program instructions specifying current and voltage levels that need to be applied to various elements of the plating cell, as well as times at which these levels need to be changed. For example, it may include program instructions for transitioning from forward current (depositing copper) to reverse current (removing copper) or from potential-control to current-control upon complete immersion of the wafer into the plating bath or at some later time.

During a forward current pulse, the power supply 435 biases the wafer 407 to have a negative potential relative to anode 413. This causes an electrical current to flow from anode 413 to the wafer 407, and an electrochemical reduction (e.g. $Cu^{2+}+2\ e^{-}=Cu^{0}$) occurs on the wafer surface (the cathode), which results in the deposition of the electrically conductive layer (e.g. copper) on the surfaces of the wafer. During a reverse current pulse, the opposite is true. The reaction on the wafer surface is an oxidation (e.g. $Cu^{0}\rightarrow Cu^{2+}+2\ e^{-}$), which results in the removal of the copper.

An inert anode 414 may be installed below the wafer 407 within the plating bath 403 and separated from the wafer region by the membrane 415. It may serve a function of an electron sink. For example, Fe(II) ions may be oxidized to Fe(III) ions on the inert anode 414. Both Fe(II) and Fe(III) ions remain dissolved in the plating solution without being deposited on the inert anode 414. Fe (III) ions are then passed through the membrane 415 and are reduced back to Fe (II) on the wafer 407, preferably on the wafer field, while oxidizing copper from elemental copper to Cu(II) ions that are dissolved back into the plating solution. Therefore, localized reduction of the iron ions may help to remove overburden from the wafer field during electroplating of the feature. The concentration balance between Fe(II) and Fe(III) may be maintained using the inert anode 414. In certain embodiments, the concentration balance tends strongly toward Fe(II). For example, the Fe(III) ions may be present in a concentration of between about 0.5 and 1.5 g/liter, while the Fe(II) ions may be present in a concentration of between about 5 and 15 g/liter. In a specific embodiment, the Fe(III) concentration is about 0.5-1 g/liter and the Fe(II) concentration is about 10 to 12 g/liter.

The apparatus may also include a heater 445 for maintaining the temperature of the plating solution at a specific level. The plating solution may be used to transfer the heat to the other elements of the plating bath. For example, when a wafer 407 is loaded into the plating bath the heater 445 and the pump 417 may be turned on to circulate the plating solution through the electroplating apparatus 401, until the temperature throughout the apparatus becomes substantially uniform. In one embodiment the heater is connected to the system controller 447. The system controller 447 may be connected to a thermocouple to receive feedback of the plating solution temperature within the electroplating apparatus and determine the need for additional heating.

Figure 5:
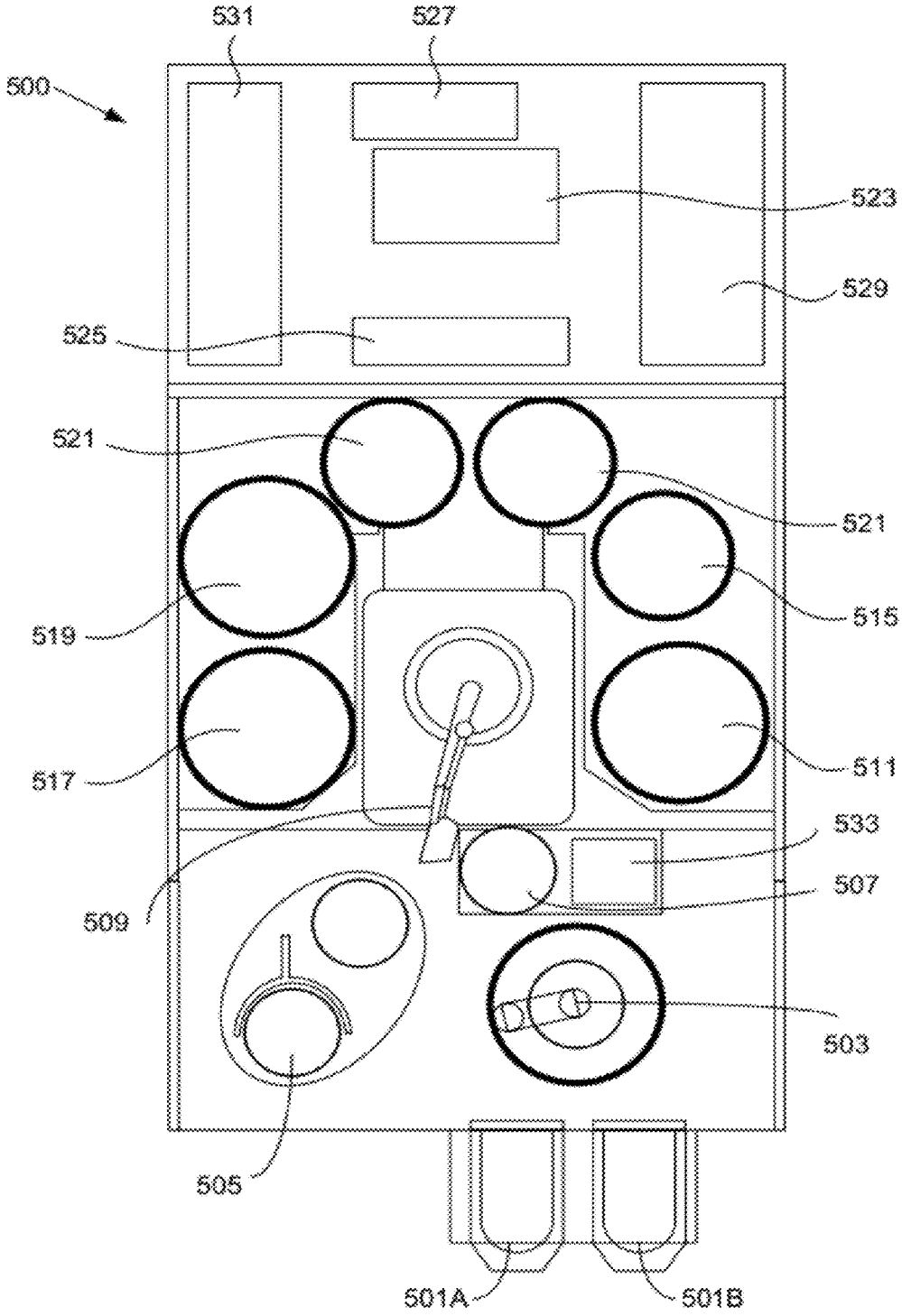
FIG. 5 depicts an electroplating system in accordance with certain embodiments.

The present invention also pertains to system level apparatus capable of executing the process flow and the process conditions described above. FIG. 5 depicts an electroplating system 500 as an embodiment of one aspect of the present invention. The system includes three separate electroplating or electroplating modules 511, 517 and 519. System 500 also includes three separate post electrofill modules (PEMs) 515 and two 521's. Each PEM may be employed to perform each of the following functions: edge bevel removal, backside etching, acid cleaning, spinning, and drying of wafers after they have been electroplated by one of modules 511, 517, and 519. System 500 also includes a chemical dilution module 525 and a primary electroplating bath 523, i.e., the plating bath of composition described above. This is a tank that holds the chemical solution used as the electroplating bath in the electroplating modules. System 500 also includes a dosing system 527 that stores and delivers chemical additives for the plating bath. A chemical dilution module 525 stores and mixes chemicals to be used as the etchant in the post electrofill modules. A filtration and pumping unit 529 filters the plating solution for central bath 523 and pumps it to the electroplating modules. Finally, an electronics unit 531 provides the electronic and interface controls required to operate system 500. Unit 531 may also provide a power supply for the system.

In operation, an atmospheric robot including a robot arm 503 selects wafers from a wafer cassette or FOUPs (front opening unified pods) such as a cassette 501A or a cassette 501B. Robot arm 503 may attach to the wafer using a vacuum attachment or some other attaching mechanism. In certain embodiments, aligner 507 includes alignment pins against which robot arm 503 pushes the wafer. When the wafer is properly aligned against the alignment pins, the robot arm 509 moves to a preset position with respect to the alignment pins. In other embodiments, the aligner 507 determines the wafer center so that the robot arm 509 picks up the wafer from the new position. It then delivers the wafer to an electrofill module such as electrofill module 511 where the copper is electroplated onto the wafer. Electrofill module 511 may employ electrolyte from a secondary bath (not shown).

Robot arm 503 moves the wafer back through the aligner 507 and transfer robot 509 to an electrofill module 517 or 519 for bulk electroplating. After the features are filled with copper, the wafer is moved to the PEMs 521. There, unwanted copper from certain locations on the wafer (namely the edge bevel region and the backside) is etched away by an etchant solution provided by chemical dilution module 525. The PEMs 521 also cleans, rinses, and dries the wafer.

After processing in post electrofill modules 521 is complete, robot arm 509 retrieves the wafer from the module and returns it to cassette 501A or 501B. A post electrofill anneal may be completed in system 500 or in another tool. In one embodiment, the post electrofill anneal is completed in one of the anneal stations 505. In other embodiments, dedicated annealing systems such as a furnace may be used. Then the cassettes can be provided to other systems such as a chemical mechanical polishing system for further processing.

Suitable semiconductor processing tools include the Sabre System manufactured by Novellus Systems of San Jose, Calif. or the Slim cell system manufactured by Applied Materials of Santa Clara, Calif., or the Raider tool manufactured by Semitool of Kalispell, Mont.

A series of experiments was conducted to determine optimal current densities for electroplating copper onto the surfaces of the dies containing three different size features: about 150 nm, about 200 nm, and about 300 nm wide trenches. Two types of electroplating solutions were compared in these experiments, each containing different bridging species. The first solution included only chloride ions, while the second solution included only bromide ions. The first solution also included about 9 ml/L of Enthone Viaform accelerator, about 2 ml/L of Enthone Viaform suppressor, and about 50 ppm of chloride ions. The second solution included about 16 ml/L of Enthone Viaform accelerator, about 8 ml/L of Enthone Viaform suppressor, and about 25 ppm of bromide ions. Both solutions had about 40 g/L of copper ions provided by copper sulfate and about 10 g/L of sulfuric acid. Each type of the die (i.e., each feature size) was electroplated using four different current densities: about 1.65 $mA/cm^2$, about 3.3 $mA/cm^2$, about 6.6 $mA/cm^2$, and about 13.2 $mA/cm^2$. The tests were conducted in a glass beaker and a concentration of organic additives was optimized for each bath. Overall, twenty four different data points were generated for all possible combinations including three feature sizes, two plating solutions, and four current densities.

Test results revealed that the initial fill rates (i.e., partial fill rates) were higher in the bromide containing solutions than in the chloride containing solutions for all current densities and feature sizes. Without being restricted to any particular theory, it is believed that the bromide ions provided stronger suppression effects in the field region and near the openings leading to more copper ions available (not deposited on the field and near the opening) for diffusion to features' bottom portions.

In the chloride containing solutions, the partial fill rates in the smaller features were greater than that in the larger features, as it has been expected. However, different size features plated using the bromide containing solution showed substantially the same fill rates. Without being restricted to any particular theory, it is believed that the stronger suppression characteristics caused by the bromide ions led to a prolonged suppression gradient even in the larger features. This finding indicates that novel plating solutions may be used for filling features of various sizes without a need to reformulate these solutions and finding new suppressor molecules suitable for each feature size range. Further, such solutions may allow electroplating substrates having both small and large features in the same operation.

Figure 6:
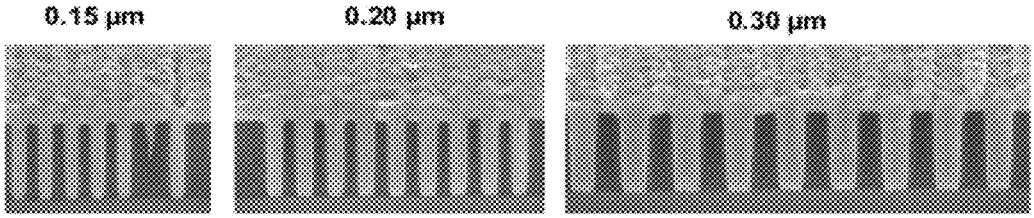
FIG. 6 illustrates Focused-Ion-Beam Scanning Electron Microscopy (FIB-SEM) images of three samples with different size feature.

These experimental results were conformed in a series of tool scale experiments. Further, the features filled using the bromide containing solutions were evaluated for presence of voids. FIG. 6 illustrates Focused-Ion-Beam Scanning Electron Microscopy (FIB-SEM) images of the cross-sections of three different size feature samples. These images confirm that there were no voids present in these features despite difference appearances of cleaved coupons in comparison to the ones filled using the chloride containing solution.

Figure 7:
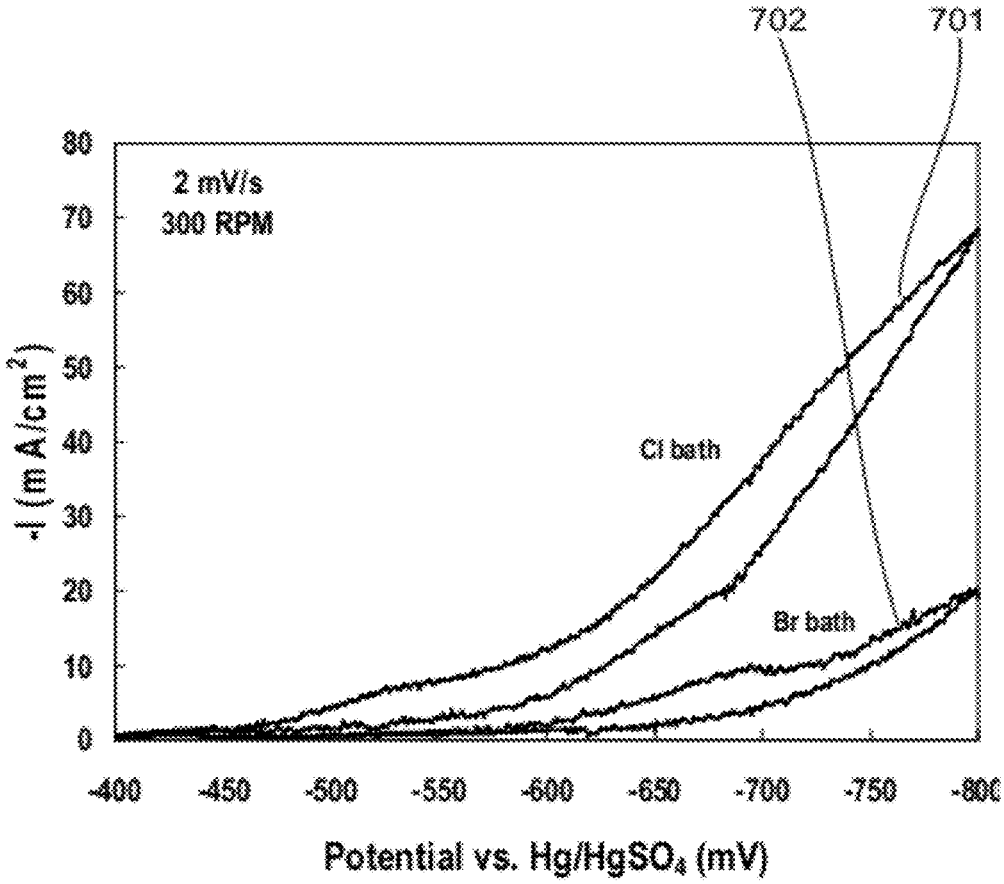
FIG. 7 illustrates two cyclic voltammograms comparing polarization effects of an electroplating solution containing chloride ions to another electroplating solution containing bromide ions.

Another series of experiments was conducted to compare polarization effects of a plating solution containing chloride ions to a plating solution containing bromide ions. FIG. 7 illustrates two cyclic voltammograms for these solutions. The top curve 701 corresponds to the solution containing chloride ions, while the bottom curve 702 corresponds to the solution containing bromide ions. Potential in the bromide containing solution was generally more negative than that in the chloride containing solution (e.g., approximately −730 mV v. −600 mV for −10 mA/cm$^2$ current density). The bromide containing solution demonstrated a hysteresis between the cathodic and anodic curves (i.e., top and bottom portions of the curve 702) similar to that of the chloride containing solution (the split in the curve 701). Such hysteresis is an indication that the deposition rates are higher inside the feature than in the field region.

Yet another series of experiment was conducted to characterize suppression effects of different plating solutions using galvanostatic polarization of the rotating platinum electrode. A thin (about 660 nm) layer of copper was plated on a platinum electrode in the electroplating solution that did not contain organic additives or bromide ions. The plated electrode was then immersed into ten different solutions representing combinations of two additive types (i.e., a suppressor only and a combination of a suppressor, accelerator, and levelers) and five different bromide ion concentrations (i.e., 0 ppm, about 500 ppb, about 1 ppm, about 2.5 ppm, and about 5 ppm). All solution included copper sulfate as a copper ion source with the concentration of copper ions about 40 g/L, about 10 g/L of sulfuric acid, and about 50 mg/L of chloride ions. A copper sheet was used as the counter electrode and a $Hg/HgSO_4$ couple as the reference electrode. The voltage between copper-coated platinum electrode and the reference electrode was monitored at constant currents while the copper-coated platinum electrode was rotated at 300 RPM.

Figure 8:
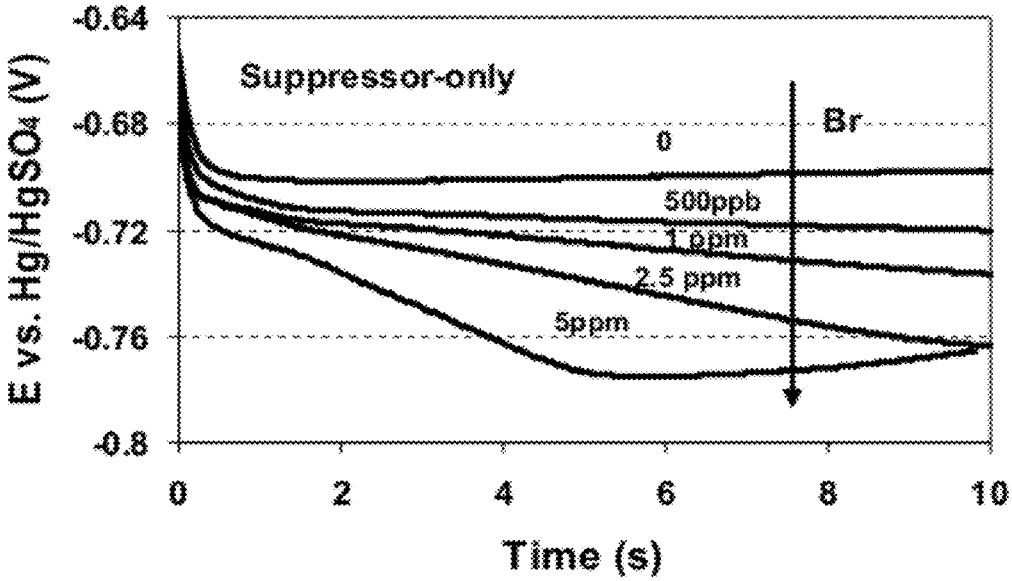
FIG. 8 illustrates galvanostatic polarization curves corresponding to electroplating solutions containing only suppressor additives and five different concentrations of bromide ions.
Figure 9:
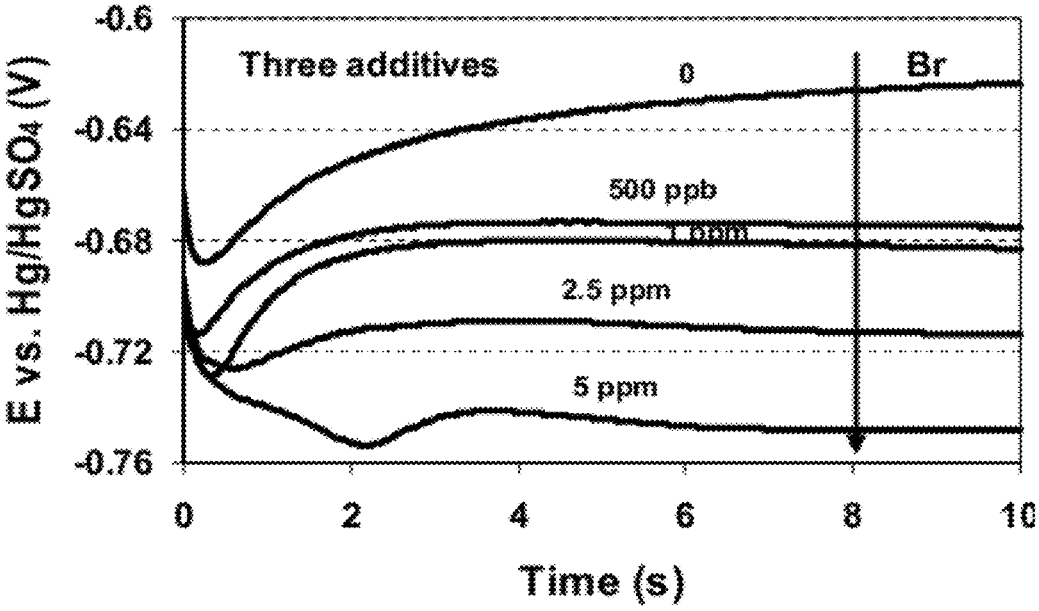
FIG. 9 illustrates galvanostatic polarization curves corresponding to electroplating solutions containing suppressor, accelerator, and leveler additives and five different concentrations of bromide ions.

FIG. 8 illustrates five galvanostatic polarization curves corresponding to plating solutions with different bromide ion concentrations and only a suppressor additive. In a similar manner, FIG. 9 illustrates five galvanostatic polarization curves corresponding to plating solutions with different bromide ion concentrations and additives including a suppressor, an accelerator, and a leveler. The graphs indicate that adding even trace amounts (i.e., 500 ppb) of bromide ions substantially increase polarization of the plating solution. For example, the plating potential is about 20 mV more negative in the suppressor only solution and 50 mV more negative in three-additive electrolyte when switching from bromide-free to 500 ppb bromide solution. To achieve a similar degree of suppression enhancement by adjusting suppressors, either a much higher (e.g., two or three orders of magnitude higher) suppressor concentration must be used or a new suppressor is required.

Experiments were conducted to determine effects of different bromide ion concentrations on fill rates in high aspect ratio features. Substrate with 0.15, 0.20, and 0.30 μm wide and 1 μm deep trenches were used. Plating solutions containing all three additives, 50 ppm of chloride ions, and bromide ion concentration of 0, 500 ppb, 1 ppm, 2.5 ppm, 5 ppm, 10 ppm, and 20 ppm were used. It has been found that the fill rate was about the same for 0 and 500 ppb bromide concentration. Further increasing the bromide concentration negatively impacted the fill rate, which probably due to over-polarization in the features. However, when similar solutions were used to test for copper nucleation along the side walls, it has been found that higher bromide concentrations (5-10 ppm v. 0.5-2.5 ppm) were beneficial to minimize bottom and sidewall voids in 120 nm features and, in particular, 32 nm features.

Figure 10A:
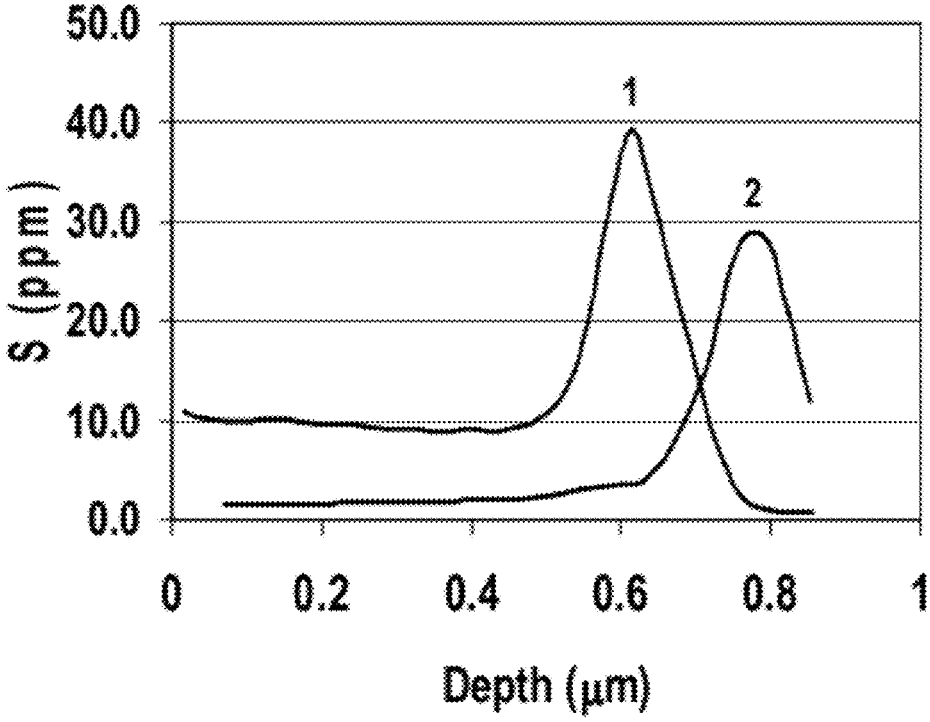
FIGS. 10A and 10B illustrate test results of the Secondary Ion Mass Spectrometer (SIMS) purity analysis of plated copper films deposited using two different electroplating solutions.
Figure 10B:
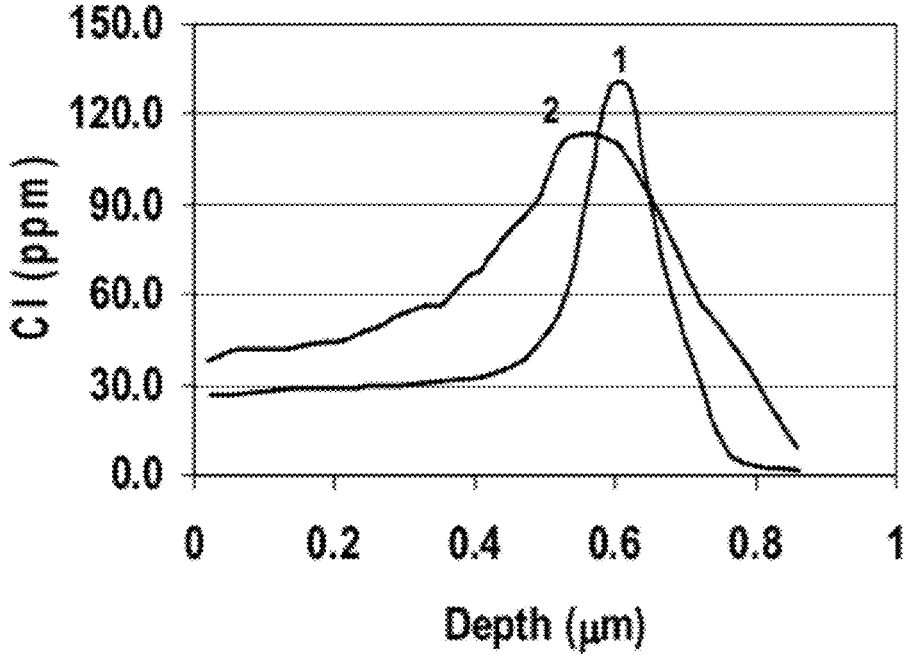

FIGS. 10A and 10B illustrate amounts of sulfur and chlorine impurities incorporated into 0.8 μm thick films deposited using two different plating solutions. The lines identified with "1" correspond to sulfur and chloride concentrations in the films deposited using a solution containing 50 ppm chloride ions (and no bromide ions). The lines identified with "2" correspond to the same impurities' concentrations in the films deposited using a solution containing 50 ppm chloride ions and 2.5 ppm bromide ions. Average sulfur concentrations for the two baths were 11.9 ppm and 6.3 ppm respectfully. Average chloride concentrations for the same two baths were 39.8 ppm and 61.4 ppm respectfully. Without being restricted to any particular theory, it is believed that the increase in the chloride concentration attributable to addition of bromide ions into the plating solution improves stress migration properties of the deposited film. At the same time, such increase in impurity levels is not expected to impact electric migration properties of the film.

CONCLUSION

Although the foregoing invention has been described in some detail for purposes of clarity of understanding, it will be apparent that certain changes and modifications may be practiced within the scope of the appended claims. It should be noted that there are many alternative ways of implementing the processes, systems, and apparatus of the present invention. Accordingly, the present embodiments are to be considered as illustrative and not restrictive, and the invention is not to be limited to the details given herein.

What is claimed is:

1. A method of electroplating copper onto a surface of a partially fabricated semiconductor substrate, which surface comprises a field region, a plurality of recessed features and a metal seed layer, the method comprising:

contacting the surface with an electroplating solution in an electroplating apparatus, the electroplating solution comprising:

copper ions, a suppressor additive, chloride ions, the concentration of the chloride ions being at least about 10 ppm, and alternative halide ions selected from the group consisting of bromide ions and iodide ions, the concentration of the alternative halide ions being about 0.5 parts per million to about 5 parts per million; and while contacting the surface with the electroplating solution, electroplating copper onto the surface of the partially fabricated semiconductor substrate by passing an electrical current to fill the plurality of recessed features with copper.

2. The method of claim 1, wherein a ratio of the concentration of the chloride ions to the concentration of the alternative halide ions is between about 1 and about 100.

3. The method of claim 1, wherein a ratio of the concentration of the chloride ions to the concentration of the alternative halide ions is between about 5 and about 25.

4. The method of claim 1, wherein the concentration of the suppressor additive is between about 10 milligrams per liter and about 500 milligrams per liter.

5. The method of claim 1, wherein the concentration of the copper ions is between about 10 grams per liter and about 70 grams per liter.

6. The method of claim 1, the electroplating solution further comprising:

an acid selected from the group consisting of sulfuric acid, methanesulfonic acid, and a combination of thereof.

7. The method of claim 6, wherein the concentration of the acid in the electroplating solution is between about 10 grams per liter and about 150 grams per liter.

8. The method of claim 1, wherein at least one of the plurality of recessed features has a width of less than about 50 nanometers.

9. The method of claim 8, wherein electroplating copper onto the surface of the partially fabricated semiconductor substrate is performed at a current density of between about 1.0 $mA/cm^2$ and 80 $mA/cm^2$.

10. The method of claim 1, wherein at least one in the plurality of recessed features has a width of at least about 500 nanometers.

11. The method of claim 10, wherein the electroplating copper onto the surface of the partially fabricated semiconductor substrate is performed at a current density of between about 1.0 $mA/cm^2$ and 50 $mA/cm^2$.

12. The method of claim 1, wherein the average thickness of the seed layer is between about 5 and 100 nanometers.

13. The method of claim 1, wherein the alternative halide ions provide additional suppression of the field region thereby increasing an electroplating potential inside the plurality of recessed features and enhancing copper nucleation on the seed layer.

14. The method of claim 1, the electroplating solution further comprising:

an accelerator additive at the concentration of between about 5 milligrams per liter and about 40 milligrams per liter, and a leveler additive at the concentration of between about 0.5 milligrams per liter and about 40 milligrams per liter.

15. The method of claim 1, wherein at least one of the plurality of recessed features has an aspect ratio of at least about 5:1.

16. The method of claim 1, wherein the copper ions are provided from a copper salt selected from the group consisting of copper methane sulfonate, copper sulfate, copper pyrophosphate, copper propanesulfonate, and combination of thereof.

17. The method of claim 1, wherein the concentration of the chloride ions is at least about 30 ppm.

18. A copper electroplating solution for electroplating copper onto a surface of a partially fabricated semiconductor substrate, which surface comprises a field region and a plurality of recessed features and a metal seed layer, the copper electroplating solution comprising:

copper ions, a suppressor additive, chloride ions, wherein the concentration of the chloride ions is at least about 10 ppm, and alternative halide ions selected from the group consisting of bromide ions and iodide ions, wherein the concentration of the alternative halide ions is about 0.5 parts per million to about 5 parts per million.

19. The copper electroplating solution of claim 18, wherein a ratio of the concentration of the chloride ions to the concentration of the alternative halide ions is between about 1 and about 100.

20. The copper electroplating solution of claim 18, wherein the concentration of the suppressor additive is between about 10 milligrams per liter and about 500 milligrams per liter.

21. The copper electroplating solution of claim 18, wherein the concentration of the copper ions is between about 10 grams per liter and about 70 grams per liter.

* * * * *